US005662307A

United States Patent [19]

Lentine

[11] Patent Number: 5,662,307

[45] Date of Patent: Sep. 2, 1997

[54] PORTABLE OUTBOARD MOTOR SUPPORT AND LIFT

[76] Inventor: Salvatore A. Lentine, 3 Lentine Dr., Flemington, N.J. 08222

[21] Appl. No.: 658,396

[22] Filed: Jun. 5, 1996

[51] Int. Cl.[6] ..... F16M 1/00

[52] U.S. Cl. ..... 248/640; 248/676; 248/371

[58] Field of Search ..... 248/640, 676, 248/158, 371, 188.4, 176.1, 664

[56] References Cited

U.S. PATENT DOCUMENTS

| | | | |
|---|---|---|---|
| 3,412,813 | 11/1968 | Johnson | 248/158 X |
| 4,508,219 | 4/1985 | O'Neill | 248/640 X |
| 4,646,996 | 3/1987 | Comstock | 248/371 X |
| 4,913,388 | 4/1990 | McCant | 248/158 X |
| 4,966,341 | 10/1990 | Borsani | 248/188.4 X |
| 5,031,842 | 7/1991 | Mohr | 248/640 |
| 5,393,251 | 2/1995 | Gilbert | 248/640 X |

*Primary Examiner*—Lanna Mai
*Attorney, Agent, or Firm*—Norman St. Landau

[57] ABSTRACT

The present invention relates to a portable outboard motor support and lift comprising a first portable base (114) securely attached to a portable base outer cylinder having an inner cylinder mounted therein. An outboard motor support is securely attached to the inner cylinder. The present invention further comprises a connecting means which functions to connect the portable base outer cylinder to the inner cylinder.

9 Claims, 5 Drawing Sheets

PORTABLE OUTBOARD MOTOR SUPPORT AND LIFT

BACKGROUND OF THE INVENTION

1. Field of the Invention

The present invention relates to portable outboard motor stands. More particularly, the present invention relates to portable outboard motor stands which also have the functionability as a lifting means.

2. Description of the Prior Art

Outboard motor supports are well known in the art. Outboard motor lifts are described in the prior art. Even though these innovations may be suitable for the specific individual purposes to which they address, they would not be suitable for the purposes of the present invention as heretofore described. However, presently there are no portable outboard motor support and lifts and therefore a need currently exists for such an item.

SUMMARY OF THE INVENTION

The present invention relates to portable outboard motor stands. More particularly, the present invention relates to portable outboard motor stands which also have the functionability as a lifting means.

The types of problems encountered in the prior art are outboard motor stands are configured with limited functionability to lift an outboard motor off a transom of a boat.

In the prior art, unsuccessful attempts to solve this problem were attempted namely: hydraulic outboard motor lifts which cradle the motor causing damage to the cover. However, the problem was solved by the present invention because the portable outboard motor support and lift emulates a boat transom and fastens onto the outboard motor with fasteners such as bolts.

Innovations within the prior art are rapidly being exploited in the field of ergodynamically designed lifts.

The present invention went contrary to the teaching of the art which describes hydraulically powered cradled outboard motor lifts.

The present invention solved a long felt need for a portable outboard motor support and lift which is inexpensive and versatile.

Accordingly, it is an object of the present invention to provide a portable outboard motor support and lift.

More particularly, it is an object of the present invention to provide a portable outboard motor support and lift which comprises a first inner cylinder having a first inner cylinder bracket.

In keeping with these objects, and with others which will become apparent hereinafter, one feature of the present invention resides, briefly stated, in the first inner cylinder optionally comprises a first inner cylinder horizontal support.

When the portable outboard motor support and lift is designed in accordance with the present invention, a first portable base outer cylinder comprises a first portable base outer cylinder bracket securely attached thereto.

In accordance with another feature of the present invention, the first portable base outer cylinder has a first portable base angle which is preferably 15°.

Another feature of the present invention is that a first portable base comprises a first portable base left member securely connected to a first portable base right member.

Yet another feature of the present invention is that the first portable base further comprises a first portable base rear left support member connected to a first portable base rear right support member by a first portable base rear middle support member therebetween.

Still another feature of the present invention is that the first portable base further comprises a first portable base front left support member and a first portable base rear right support member.

Yet still another feature of the present invention is that the first portable base left member comprises a first portable base left-front castor and a first portable base left-rear castor securely mounted thereon.

Still yet another feature of the present invention is that the first portable base left-rear castor comprises a first portable base left-rear castor height adjustment.

Another feature of the present invention is that the first portable base right member comprises a first portable base right-front castor and a first portable base right-rear castor.

Yet another feature of the present invention is that the first portable base right-rear castor comprises a first portable base right-rear castor height adjustment.

Still another feature of the present invention is that the first outboard motor support comprises a first outboard motor support left member having a first outboard motor support left member opening and further comprises a first outboard motor support left member bracket having a first outboard motor support left member bracket opening.

Yet still another feature of the present invention is that first outboard motor support comprises a first outboard motor support right member having a first outboard motor support right member opening and further comprises a first outboard motor support right member bracket having a first outboard motor support right member bracket opening.

Still yet another feature of the present invention is that the first outboard motor support further comprises a first outboard motor support middle member.

Another feature of the present invention is that a lifting means is optionally a bottle jack.

Yet another feature of the present invention is that the portable outboard motor support and lift comprises a second inner cylinder having a plurality of second inner cylinder openings therein.

Still another feature of the present invention is that the second portable base outer cylinder comprises a plurality of second portable base outer cylinder opening therein.

Yet still another feature of the present invention is that second portable base outer cylinder has a second portable base horizontal support.

Still yet another feature of the present invention is that the second portable base outer cylinder is at a second portable base outer cylinder angle which is preferably 15°.

Another feature of the present invention is that the second outboard motor support comprises a second outboard motor support center member having a second outboard motor support center member connector.

Yet another feature of the present invention is that the second outboard motor support comprises a second outboard motor support left member having a second outboard motor support left member opening.

Still another feature of the present invention is that the second outboard motor support comprises a second outboard motor support right member having a second outboard motor support right member opening therein.

Yet still another feature of the present invention is that the second outboard motor support comprises a second outboard motor support middle top member and a second outboard motor support middle bottom member having a second outboard motor support middle bottom member right opening (216MBR) and a second outboard motor support middle bottom member left opening (216MBL) therein.

Still yet another feature of the present invention is that a pin is positionable through the second inner cylinder opening and the second portable base outer cylinder thereby functioning as a connecting means for height adjustment.

The novel features which are considered characteristic for the invention are set forth in the appended dawns. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

FIRST EMBODIMENT

110—first portable outboard motor support and lift (110)

112—first inner cylinder (112)

112A—first inner cylinder bracket (112A)

112B—first inner cylinder horizontal support (112B)

114A—first portable base outer cylinder (114A)

114AA—first portable base outer cylinder bracket (114AA)

114F—first portable base angle (114F)

114—first portable base (114)

114BL—first portable base left member (114BL)

114BR—first portable base right member (114BR)

114CL—first portable base rear left support member (114CL)

114CR—first portable base rear right support member (114CR)

114CM—first portable base rear middle support member (114CM)

114DL—first portable base front left support member (114DL)

114DR—first portable base rear right support member (114DR)

114ELF—first portable base left-from castor (114ELF)

114ELR—first portable base left-rear castor (114ELR)

114ELRA—first portable base left-rear castor height adjustment (114ELRA)

114ERF—first portable base right-front castor (114ERF)

114ERR—first portable base right-rear castor (114ERR)

114ERRA—first portable base right-rear castor height adjustment (114ERRA)

116—first outboard motor support (116)

116L—first outboard motor support left member (116L)

116LA—first outboard motor support left member opening (116LA)

116LB—first outboard motor support left member bracket (116LB)

116LBA—first outboard motor support left member bracket opening (116LBA)

116R—first outboard motor support right member (116R)

116RA—first outboard motor support right member opening (116RA)

116RB—first outboard motor support right member bracket (116RB)

116RBA—first outboard motor support right member bracket opening (116RBA)

116M—first outboard motor support middle member (116M)

118—bottle jack (118)

120—bolt (120)

SECOND EMBODIMENT

210—second portable outboard motor support and lift (210)

212—second inner cylinder (212)

212A—second inner cylinder opening (212A)

214A—second portable base outer cylinder (214A)

214AA—second portable base outer cylinder opening (214AA)

214B—second portable base horizontal support (214B)

214F—second portable base outer cylinder angle (214F)

216—second outboard motor support (216)

216C—second outboard motor support center member (216C)

216CA—second outboard motor support center member connector (216CA)

216L—second outboard motor support left member (216L)

216LA—second outboard motor support left member opening (216LA)

216R—second outboard motor support right member (216R)

216RA—second outboard motor support right member opening (216RA)

216MA—second outboard motor support middle top member (216MA)

216MB—second outboard motor support middle bottom member (216MB)

216MBR—second outboard motor support middle bottom member right opening (216MBR)

216MBL—second outboard motor support middle bottom member left opening (216MBL)

218—pin (218)

DESCRIPTION OF THE PREFERRED EMBODIMENT

Figure 1:
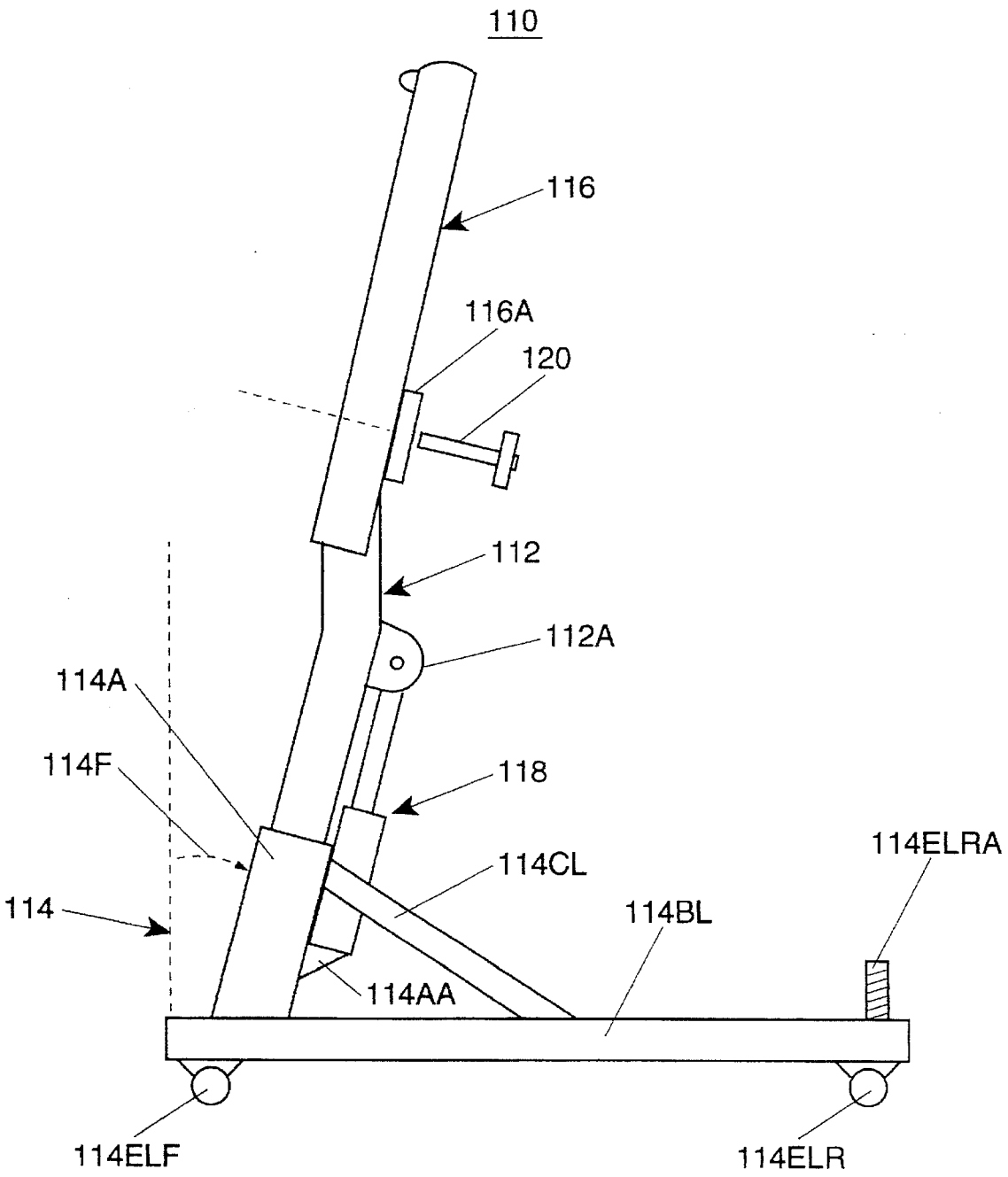
FIG. 1 is a left side view of a first portable outboard motor support and lift.
Figure 1A:
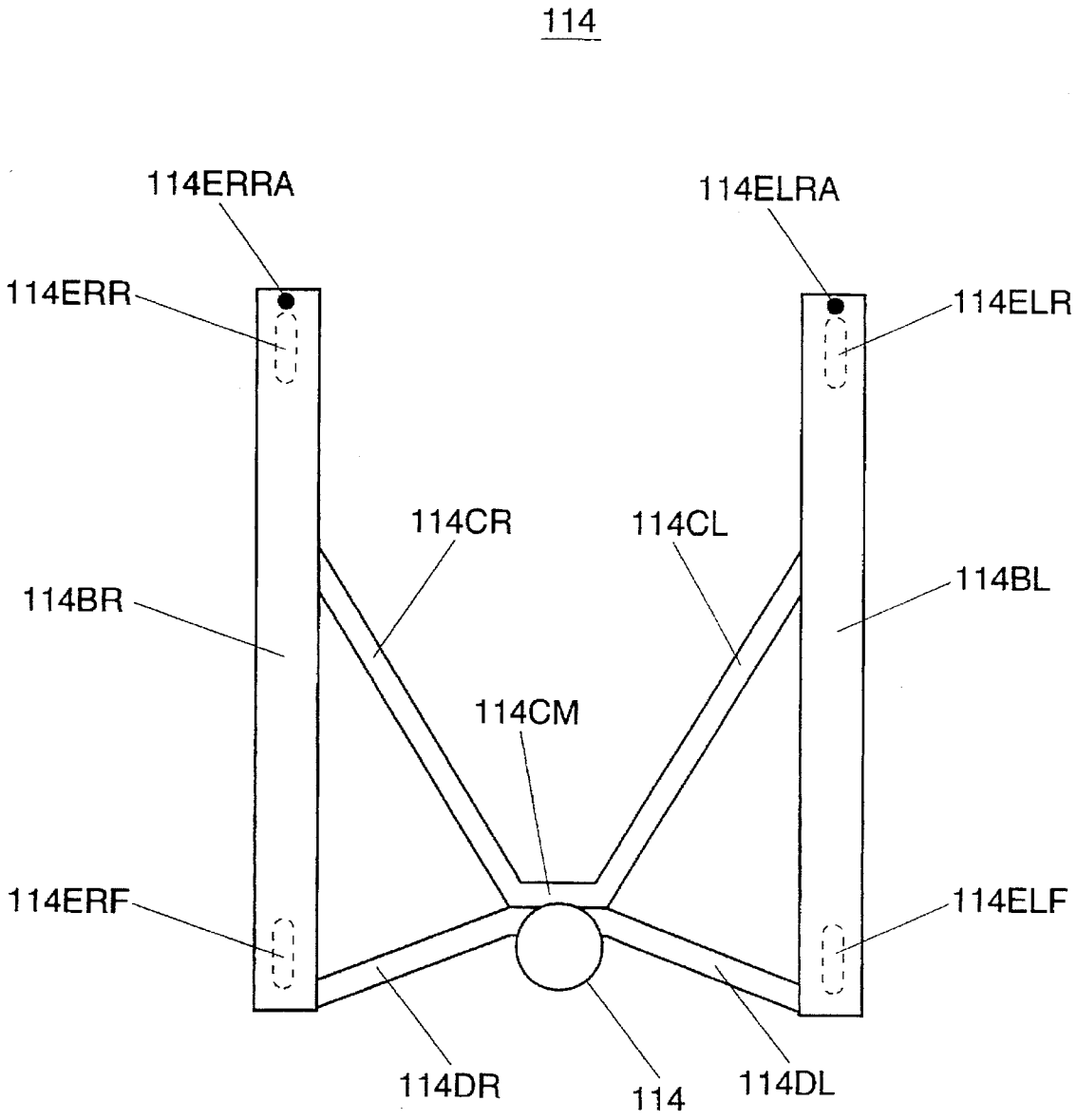
FIG. 1A is a top view of a first portable base.

Firstly, referring to FIG. 1 which is a left side view of a first portable outboard motor support and lift (110) and FIG. 1A which is a top view of a first portable base (114). A first portable base (114) which comprises a first portable base left member (114BL) having a first portable base left-front castor (114ELF) is securely mounted on a from distal end and a first portable base left-rear castor (114ELR) securely mounted on a rear distal end. A first portable base right member (114BR) having a first portable base right-front castor (114ERF) is securely mounted on a front distal end and a first portable base right-rear castor (114ERR) securely mounted on a rear distal end. The first portable base left-rear castor (114ELR) comprises a first portable base left-rear castor height adjustment (114ELRA) and the first portable base right-rear castor (114ERR) comprises a first portable base right-rear castor height adjustment (114ERRA).

A first portable base rear left support member (114CL) is securely fastened at an outer distal end to the first portable base left member (114BL). The first portable base rear left support member (114CL) is also securely fastened at an inner distal end to a first portable base rear middle support member (114CM). A first portable base rear right support member (114CR) is securely fastened at an outer distal end to the first portable base right member (114BR). The first portable base rear right support member (114CR) is securely fastened at an inner distal end to the first portable base rear middle support member (114CM). A portable base outer cylinder is securely fastened to the first portable base rear middle support member (114CM). The portable base outer cylinder is selected from a group of portable base outer cylinders consisting of first portable base outer cylinder (114A) and second portable base outer cylinder (214A). The first portable base outer cylinder (114A) comprises a first portable base outer cylinder bracket (114AA) securely fastened thereto. The first portable base outer cylinder (114A) is at a first portable base angle (114F) which is in the range from 10° to 20°. The first portable base outer cylinder (114A) is at a first portable base angle (114F) of 18°. A first portable base front left support member (114DL) is securely fastened at an outer distal end to the first portable base left member (114BL). The first portable base front left support member (114DL) is also securely fastened at an inner distal end to the portable base outer cylinder. A first portable base rear right support member (114DR) is securely fastened at an outer distal end to the first portable base right member (114BR). The first portable base rear right support member (114DR) is securely fastened at an inner distal end to the portable base outer cylinder.

An inner cylinder having a bottom end is slidably mounted within the portable base outer cylinder. The inner cylinder is selected from a group consisting of first inner cylinder (112) and second inner cylinder (212). The first inner cylinder (112) comprises a first inner cylinder bracket (112A) extending therefrom. The first inner cylinder (112) comprises a first inner cylinder horizontal support (112B) which functions to give the outboard motor support additional strength. The outboard motor support is selected from a group consisting of first outboard motor support (116) and second outboard motor support (216).

A connecting means functions to connect the portable base outer cylinder to the inner cylinder. The connecting means is selected from a group consisting of a bottle jack (118) and a pin (218). The bottle jack (118) is attached at a top distal end to the first inner cylinder bracket (112A) and is attached at a bottom distal end to the first portable base outer cylinder bracket (114AA). The bottle jack (118) is preferably a manually operated hydraulic means whereby the first inner cylinder (112) is moved upwardly or downwardly within the first portable base outer cylinder (114A).

The first portable outboard motor support and lift (110) is manufactured from a material selected from a group consisting of metal, metal alloy, plastic, plastic composite, rubber, rubber composite, rubber, and rubber composite.

Figure 2A:
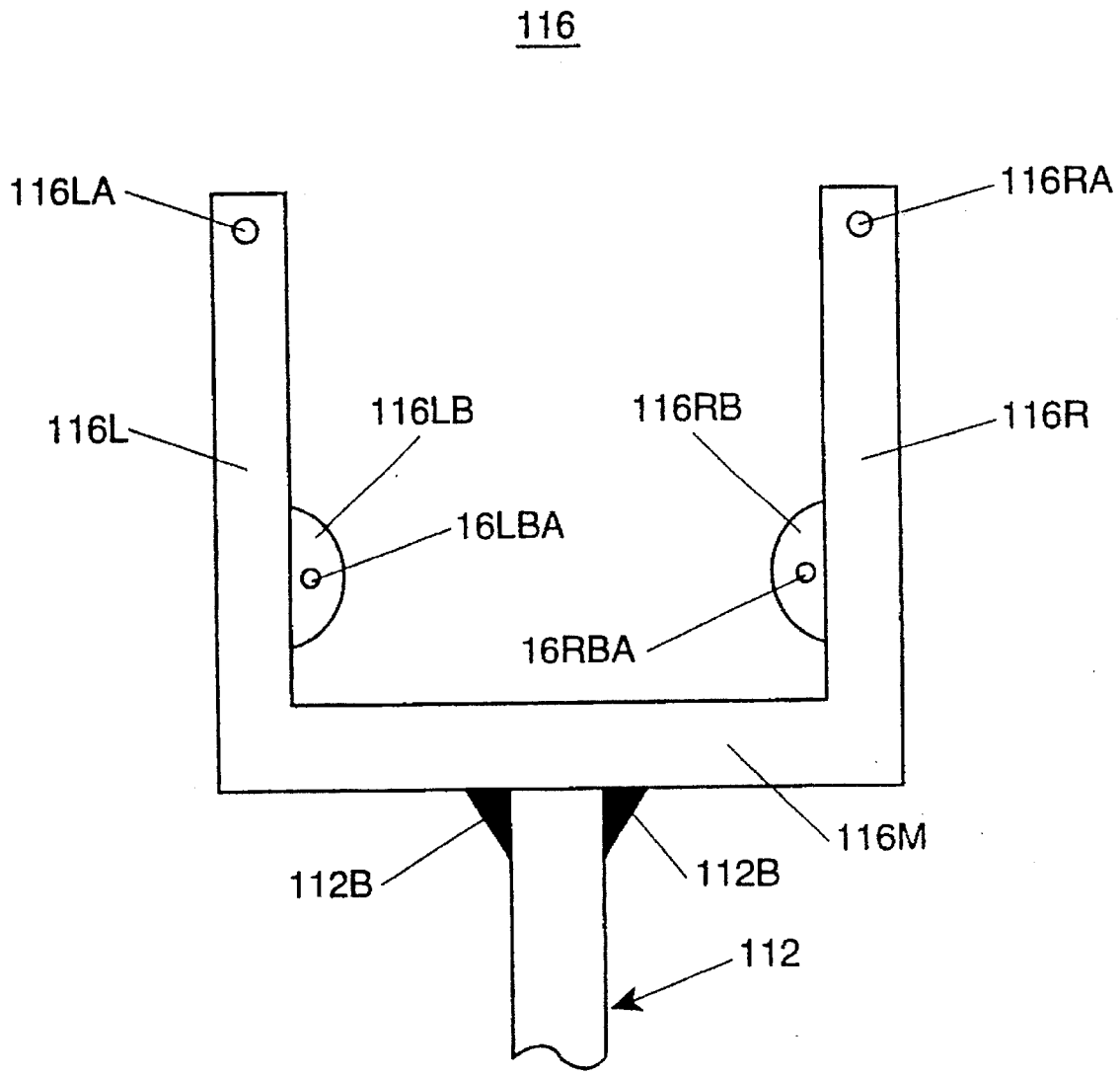
FIG. 2A is a front view of a first outboard motor support.

Referring to FIG. 2A is a front view of a first outboard motor support (116). The first outboard motor support (116) comprises first outboard motor support left member (116L) securely connected to a first outboard motor support right member (116R) by a first outboard motor support middle member (116M) therebetween. The first outboard motor support left member (116L) comprises at least one first outboard motor support left member opening (116LA) positioned at a top end therein. The first outboard motor support left member (116L) further comprises at least one first outboard motor support left member bracket (116LB) securely attached thereto at a bottom end. The first outboard motor support left member (116L) further comprises a first outboard motor support left member bracket opening (116LBA). The first outboard motor support right member (116R) comprises at least one first outboard motor support right member opening (116RA) positioned at a top end therein. The first outboard motor support right member (116R) further comprises at least one first outboard motor support right member bracket (116RB) securely attached thereto at a bottom end. The first outboard motor support right member (116R) further comprises a first outboard motor support right member bracket opening (116RBA).

Figure 2B:
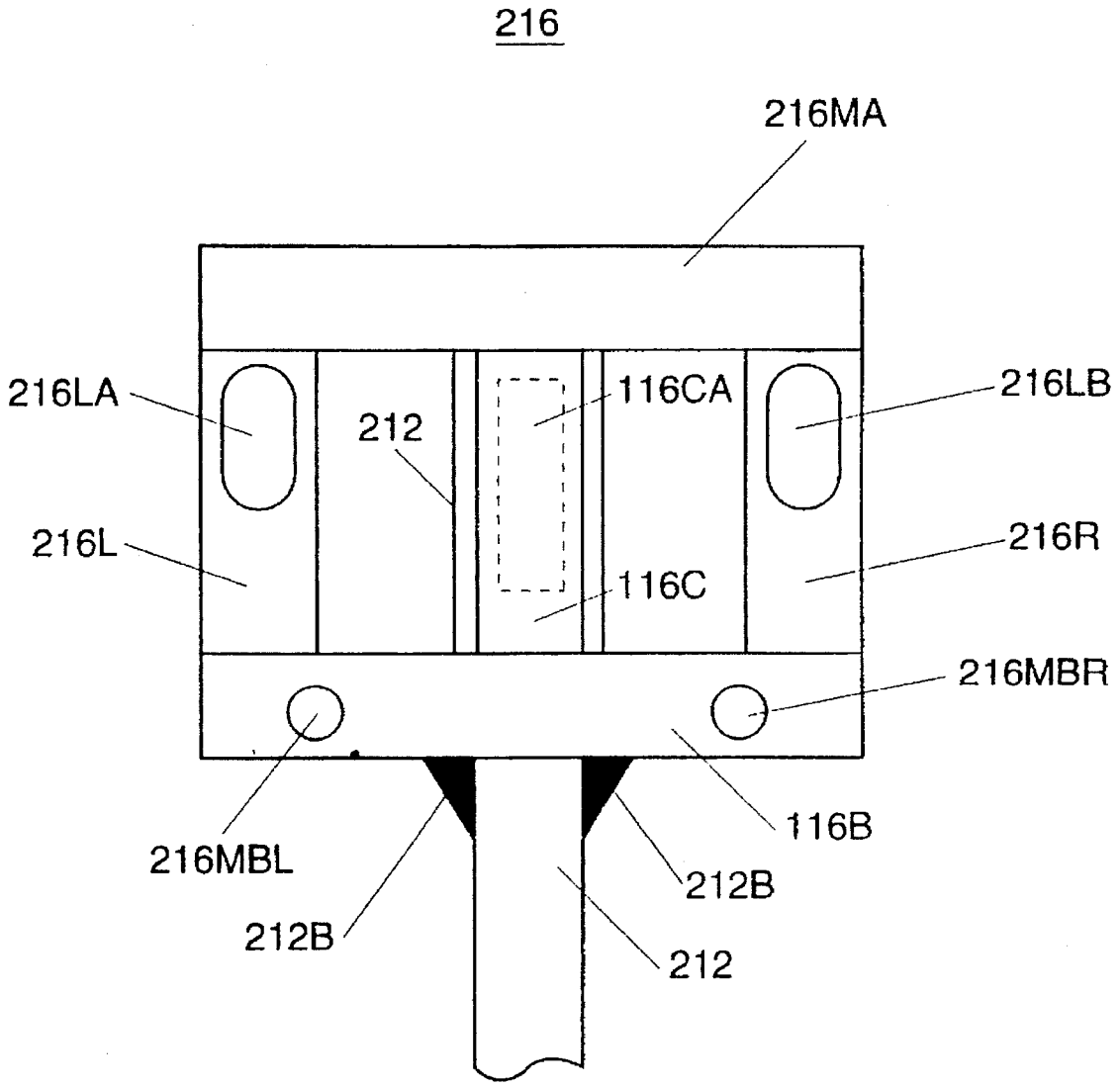
FIG. 2B is a front view of a second outboard motor support.

Now referring to FIG. 2B which is a from view of a second outboard motor support (216). The second outboard motor support (216) comprises a second outboard motor support middle top member (216MA) securely connected to a second outboard motor support middle bottom member (216MB) by a second outboard motor support left member (216L) and a second outboard motor support center member (216C) and a second outboard motor support right member (216R). The second outboard motor support left member (216L) comprises at least one second outboard motor support left member opening (216LA) therein. The second outboard motor support right member (216R) comprises at least one second outboard motor support right member opening (216RA) therein. The second outboard motor support middle bottom member (216MB) comprises at least one second outboard motor support middle bottom member right opening (216MBR) therein. The second outboard motor support middle bottom member (216MB) further comprises at least one second outboard motor support middle bottom member left opening (216MBL). The second outboard motor support center member (216C) comprises a second outboard motor support center member connector (216CA) which is attachable to at top end of the inner cylinder.

Figure 3:
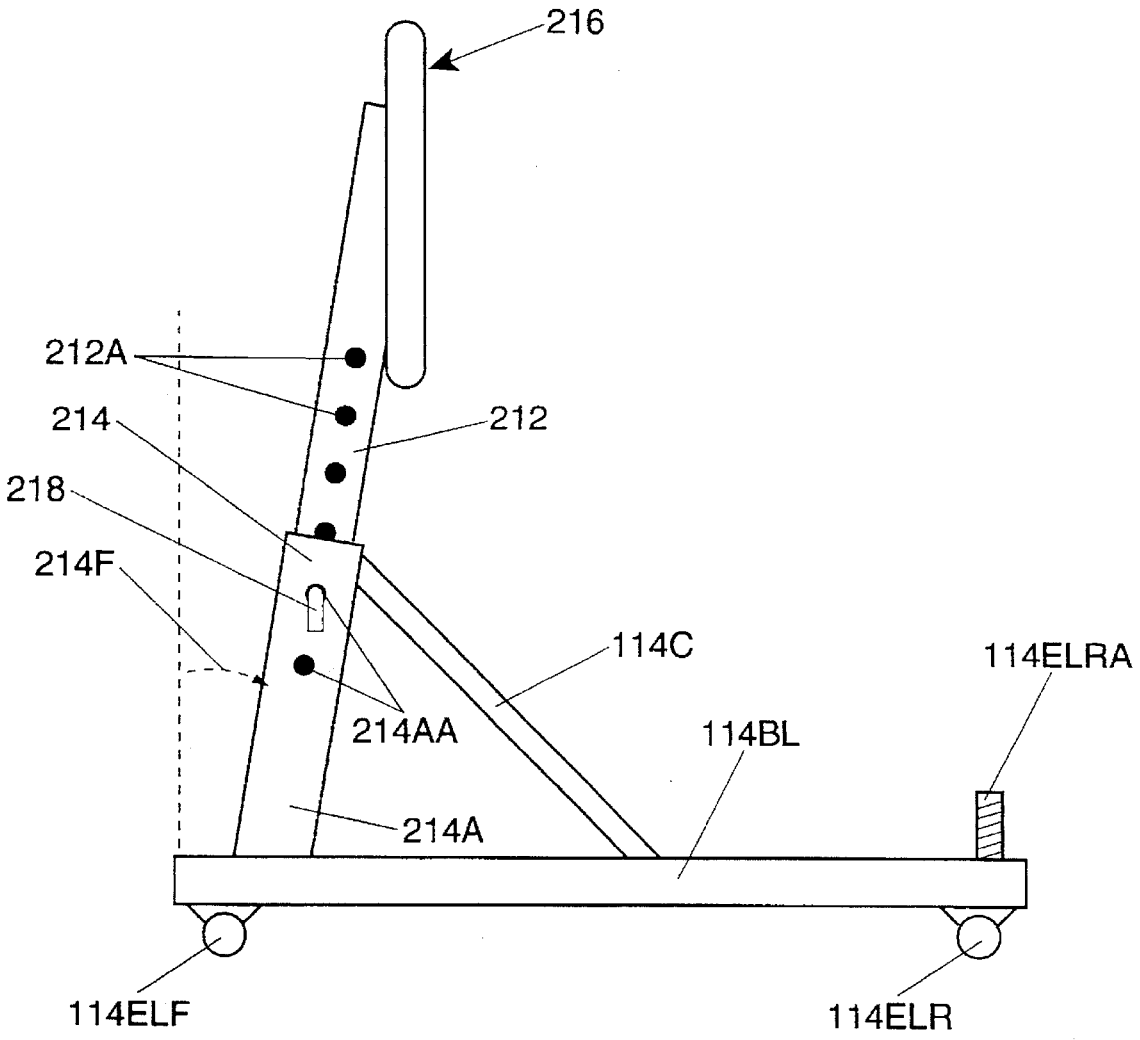
FIG. 3 second portable outboard motor support and lift.

Lastly, referring to FIG. 3 which is second portable outboard motor support and lift (210). The portable base outer cylinder is selected from a group of portable base outer cylinders consisting of first portable base outer cylinder (114A). and second portable base outer cylinder (214A). The second portable base outer cylinder (214A) comprises a plurality of second portable base outer cylinder openings (214AA) positioned longitudinally thereon. The inner cylinder is selected from a group consisting of first inner cylinder (112) and second inner cylinder (212). The second inner cylinder (212) comprises a plurality of second inner cylinder openings (212A) positioned longitudinally thereon. The second inner cylinder openings (212A) are positioned in a spaced relationship which is complimentary to a spaced relationship of the second portable base outer cylinder openings (214AA). An outboard motor support securely fastened to a top end of the inner cylinder. The second portable base outer cylinder (214A) comprises a second portable base horizontal support (214B) which functions to give the outboard motor support additional strength. The portable base outer cylinder is selected from a group of portable base outer cylinders consisting of first portable base outer cylinder (114A) and second portable base outer cylinder (214A). The second portable base outer cylinder (214A) is at a second portable base outer cylinder angle (214F) which is in the range from 10° to 20°. the second portable base outer cylinder (214A) is at a second portable base outer cylinder angle (214F) which is 15°.

The inner cylinder is selected from a group consisting of first inner cylinder (112) and second inner cylinder (212). The first inner cylinder (112) comprises a first inner cylinder bracket (112A) extending therefrom. The outboard motor support is selected from a group consisting of first outboard motor support (116) and second outboard motor support (216). The pin (218) is removably connectable through the second inner cylinder opening (212A) and the second portable base outer cylinder opening (214AA). The pin (218) functions as a connecting means whereby the second inner cylinder (212) is securely fastened to the second portable base outer cylinder (214A) when a desired height of the outboard motor support is attained by the user.

The second portable outboard motor support and lift (210) is manufactured from a material selected from a group consisting of metal, metal alloy, plastic, plastic composite, rubber, rubber composite, rubber, and rubber composite.

It will be understood that each of the elements described above, or two or more together, may also find a useful application in other types of constructions differing from the type described above.

While the invention has been illustrated and described as embodied in portable outboard motor support and lift, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A portable outboard motor support and lift comprising:

A) a first portable base (114) which comprises:

I) a first portable base left member (114BL) having a first portable base left-front castor (114ELF) securely mounted on a front distal end and a first portable base left-rear castor (114ELR) securely mounted on a rear distal end, ii) a first portable base right member (114BR) having a first portable base right-front castor (114ERF) securely mounted on a front distal end and a first portable base right-rear castor (114ERR) securely mounted on a rear distal end, iii) a first portable base rear left support member (114CL) securely fastened at an outer distal end to the first portable base left member (114BL) and securely fastened at an inner distal end to a first portable base rear middle support member (114CM), iv) a first portable base rear right support member (114CR) securely fastened at an outer distal end to the first portable base right member (114BR) and securely fastened at an inner distal end to the first portable base rear middle support member (114CM), v) a portable base outer cylinder securely fastened to the first portable base rear middle support member (114CM), the portable base outer cylinder is selected from a group of portable base outer cylinders consisting of first portable base outer cylinder (114A) and second portable base outer cylinder (214A), the first portable base outer cylinder (114A) comprises a first portable base outer cylinder bracket (114AA) securely fastened thereto, the second portable base outer cylinder (214A) comprises a plurality of second portable base outer cylinder opening (214AA) positioned longitudinally thereon, v) a first portable base front left support member (114DL) securely fastened at an outer distal end to the first portable base left member (114BL) and securely fastened at an inner distal end to the portable base outer cylinder, and vi) a first portable base rear right support member (114DR) securely fastened at an outer distal end to the first portable base right member (114BR) and securely fastened at an inner distal end to the portable base outer cylinder;

B) an inner cylinder having a bottom end slidably mounted within the portable base outer cylinder, the inner cylinder is selected from a group consisting of first inner cylinder (112) and second inner cylinder (212), the first inner cylinder (112) comprises a first inner cylinder bracket (112A) extending therefrom, the second inner cylinder (212) comprises a plurality of second inner cylinder openings (212A) positioned longitudinally thereon, the second inner cylinder openings (212A) are positioned in a spaced relationship which is complimentary to a spaced relationship of the second portable base outer cylinder openings (214AA);

C) an outboard motor support securely fastened to a top end of the inner cylinder, the outboard motor support is selected from a group consisting of first outboard motor support (116) and second outboard motor support (216), the first outboard motor support (116) comprises first outboard motor support left member (116L) securely connected to a first outboard motor support right member (116R) by a first outboard motor support middle member (116M) therebetween, the first outboard motor support left member (116L) comprises at least one first outboard motor support left member opening (116LA) positioned at a top end therein, the first outboard motor support left member (116L) further comprises at least one first outboard motor support left member bracket (116LB) securely attached thereto at a bottom end, the first outboard motor support left member (116L) further comprises a first outboard motor support left member bracket opening (116LBA), the first outboard motor support right member (116R) comprises at least one first outboard motor support right member opening (116RA) positioned at a top end therein, the first outboard motor support right member (116R) further comprises at least one first outboard motor support right member bracket (116RB) securely attached thereto at a bottom end, the first outboard motor support right member (116R) further comprises a first outboard motor support right member bracket opening (116RBA), the second outboard motor support (216) comprises a second outboard motor support middle top member (216MA) securely connected to a second outboard motor support middle bottom member (216MB) by a second outboard motor support left member (216L) and a second outboard motor support center member (216C) and a second outboard motor support right member (216R), the second outboard motor support left member (216L) comprises at least one second outboard motor support left member opening (216LA) therein, the second outboard motor support right member (216R) comprises at least one second outboard motor support right member opening (216RA) therein, the second outboard motor support middle bottom member (216MB) comprises at least one second outboard motor support middle bottom member right opening (216MBR) therein and at least one second outboard motor support middle bottom member left opening (216MBL), the second outboard motor support center member (216C) comprises a second outboard motor support center member connector (216CA) which is attachable to at top end of the inner cylinder;

D) a connecting means which functions to connect the portable base outer cylinder to the inner cylinder, the connecting means is selected from a group consisting of a bottle jack (118) and a pin (218), the bottle jack (118) is attached at a top distal end to the first inner cylinder bracket (112A) and is attached at a bottom distal end to the first portable base outer cylinder bracket (114AA), the pin (218) is removably connectable through the second inner cylinder opening (212A) and the second portable base outer cylinder opening (214AA).

2. The portable outboard motor support and lift as described in claim 1, wherein the first inner cylinder (112) comprises a first inner cylinder horizontal support (112B) which functions to give the outboard motor support additional strength.

3. The portable outboard motor support and lift as described in claim 1, wherein the first portable base outer cylinder (114A) is at a first portable base angle (114F) which is in the range from 10° to 20°.

4. The portable outboard motor support and lift as described in claim 3, wherein the first portable base outer cylinder (114A) is at a first portable base angle (114F) of 18°.

5. The portable outboard motor support and lift as described in claim 1, wherein the first portable base left-rear castor (114ELR) comprises a first portable base left-rear castor height adjustment (114ELRA) and the first portable base right-rear castor (114ERR) comprises a first portable base right-rear castor height adjustment (114ERRA).

6. The portable outboard motor support and lift as described in claim 1, wherein the second portable base outer cylinder (214A) comprises a second portable base horizontal support (214B) which functions to give the outboard motor support additional strength.

7. The portable outboard motor support and lift as described in claim 1, wherein the second portable base outer cylinder (214A) is at a second portable base outer cylinder angle (214F) which is in the range from 10° to 20°.

8. The portable outboard motor support and lift as described in claim 7, wherein the second portable base outer cylinder (214A) is at a second portable base outer cylinder angle (214F) which is 15°.

9. The portable outboard motor support and lift as described in claim 1 is manufactured from a material selected from a group consisting of metal, metal alloy, plastic, plastic composite, rubber, rubber composite, rubber, and rubber composite.

* * * * *